US011519247B2

(12) United States Patent
Langford et al.

(10) Patent No.: US 11,519,247 B2
(45) Date of Patent: Dec. 6, 2022

(54) SELECT FIRE PERFORATING CARTRIDGE SYSTEM

(71) Applicant: Hunting Titan, Inc., Pampa, TX (US)

(72) Inventors: Dale Langford, Pampa, TX (US); Charles Levine, Waxahachie, TX (US); Andy Lane, Lubbock, TX (US); Faraidoon Pundole, Sugar Land, TX (US); Joel Sansing, Wichita Falls, TX (US)

(73) Assignee: Hunting Titan, Inc., Pampa, TX (US)

( * ) Notice: Subject to any disclaimer, the term of this patent is extended or adjusted under 35 U.S.C. 154(b) by 554 days.

(21) Appl. No.: 16/335,850

(22) PCT Filed: Sep. 22, 2017

(86) PCT No.: PCT/US2017/053025

§ 371 (c)(1),
(2) Date: Mar. 22, 2019

(87) PCT Pub. No.: WO2018/057934

PCT Pub. Date: Mar. 29, 2018

(65) Prior Publication Data

US 2019/0257181 A1 Aug. 22, 2019

Related U.S. Application Data

(60) Provisional application No. 62/398,975, filed on Sep. 23, 2016.

(51) Int. Cl.
*E21B 43/1185* (2006.01)
*E21B 43/119* (2006.01)

(52) U.S. Cl.
CPC ..... *E21B 43/1185* (2013.01); *E21B 43/119* (2013.01)

(58) Field of Classification Search
CPC .. E21B 43/1185; E21B 43/119; E21B 43/117; E21B 43/1193; E21B 43/116; F42D 1/05; F42D 1/055; F42D 1/045; F42D 1/06
See application file for complete search history.

(56) References Cited

U.S. PATENT DOCUMENTS

| | | | | |
|---|---|---|---|---|
| 4,850,438 | A | 7/1989 | Regalbuto | |
| 9,080,433 | B2 * | 7/2015 | Lanclos | F42D 1/05 |
| 2012/0037365 | A1 * | 2/2012 | Torres | E21B 43/119 166/297 |
| 2016/0245057 | A1 * | 8/2016 | Hardesty | F42D 1/05 |

OTHER PUBLICATIONS

Notification of Transmittal of the International Search Report and the Written Opinion of the International Searching Authority, PCT Application No. PCT/US17/53025, dated Jan. 17, 2018, 11 pages.

(Continued)

*Primary Examiner* — George S Gray

(57) ABSTRACT

A method and apparatus for using a tandem sub between two perforating guns where an EB fire pressure switch arms a detonator after the detonation of a first perforating gun and then a subsequent electrical signal can then detonate the second perforating gun.

8 Claims, 3 Drawing Sheets

(56) References Cited

OTHER PUBLICATIONS

Communication with Supplementary European Search Report for European Application No. 17854013.4, dated Aug. 3, 2020, 11 pages.
Office action dated Dec. 2, 2020, Canadian application No. 3,037,879, 4 pages.
Response to office action dated Dec. 2, 2020, dated Jan. 21, 2021, Canadian application No. 3,037,879, 6 pages.
Office action dated Jun. 8, 2021, Canadian application No. 3,037,879, 3 pages.
Response to office action dated Jun. 8, 2021, dated Oct. 7, 2021, Canadian application No. 3,037,879, 8 pages.

* cited by examiner

SELECT FIRE PERFORATING CARTRIDGE SYSTEM

RELATED APPLICATIONS

This application claims priority to U.S. Provisional Application No. 62/398,975, filed Sep. 23, 2016.

BACKGROUND OF THE INVENTION

Generally, when completing a subterranean well for the production of fluids, minerals, or gases from underground reservoirs, several types of tubulars are placed downhole as part of the drilling, exploration, and completions process. These tubulars can include casing, tubing, pipes, liners, and devices conveyed downhole by tubulars of various types. Each well is unique, so combinations of different tubulars may be lowered into a well for a multitude of purposes.

A subsurface or subterranean well transits one or more formations. The formation is a body of rock or strata that contains one or more compositions. The formation is treated as a continuous body. Within the formation hydrocarbon deposits may exist. Typically a wellbore will be drilled from a surface location, placing a hole into a formation of interest. Completion equipment will be put into place, including casing, tubing, and other downhole equipment as needed. Perforating the casing and the formation with a perforating gun is a well known method in the art for accessing hydrocarbon deposits within a formation from a wellbore.

Explosively perforating the formation using a shaped charge is a widely known method for completing an oil well. A shaped charge is a term of art for a device that when detonated generates a focused explosive output. This is achieved in part by the geometry of the explosive in conjunction with an adjacent liner. Generally, a shaped charge includes a metal case that contains an explosive material with a concave shape, which has a thin metal liner on the inner surface. Many materials are used for the liner; some of the more common metals include brass, copper, tungsten, and lead. When the explosive detonates the liner metal is compressed into a super-heated, super pressurized jet that can penetrate metal, concrete, and rock. Perforating charges are typically used in groups. These groups of perforating charges are typically held together in an assembly called a perforating gun. Perforating guns come in many styles, such as strip guns, capsule guns, port plug guns, and expendable hollow carrier guns.

Perforating charges are typically detonated by detonating cord in proximity to a priming hole at the apex of each charge case. Typically, the detonating cord terminates proximate to the ends of the perforating gun. In this arrangement, a detonator at one end of the perforating gun can detonate all of the perforating charges in the gun and continue a ballistic transfer to the opposite end of the gun. In this fashion, numerous perforating guns can be connected end to end with a single detonator detonating all of them.

The detonating cord is typically detonated by a detonator triggered by a firing head. The firing head can be actuated in many ways, including but not limited to electronically, hydraulically, and mechanically.

Expendable hollow carrier perforating guns are typically manufactured from standard sizes of steel pipe with a box end having internal/female threads at each end. Pin ended adapters, or subs, having male/external threads are threaded one or both ends of the gun. These subs can connect perforating guns together, connect perforating guns to other tools such as setting tools and collar locators, and connect firing heads to perforating guns. Subs often house electronic, mechanical, or ballistic components used to activate or otherwise control perforating guns and other components.

Perforating guns typically have a cylindrical gun body and a charge tube, or loading tube that holds the perforating charges. The gun body typically is composed of metal and is cylindrical in shape. Within a typical gun tube is a charge holder designed to hold the shaped charges. Charge holders can be formed as tubes, strips, or chains. The charge holder will contain cutouts called charge holes to house the shaped charges.

It is generally preferable to reduce the total length of any tools to be introduced into a wellbore. Among other potential benefits, reduced tool length reduces the length of the lubricator necessary to introduce the tools into a wellbore under pressure. Additionally, reduced tool length is also desirable to accommodate turns in a highly deviated or horizontal well. It is also generally preferable to reduce the tool assembly that must be performed at the well site because the well site is often a harsh environment with numerous distractions and demands on the workers on site.

Currently, perforating guns are often assembled and loaded at a service company shop, transported to the well site, and then armed before they are deployed into a well. Sometimes perforating guns are assembled and armed at the well site. Because the service company shop often employs a single gun loader, maintaining close control on the gun assembly/loading procedures can become difficult. Accordingly, quality control on the assembled/loaded guns may be improved by reducing the amount of assembly necessary at the service company shop.

Many perforating guns are electrically activated. This requires electrical wiring to at least the firing head for the perforating gun. In many cases, perforating guns are run into the well in strings where guns are activated either singly or in groups, often separate from the activation of other tools in the string, such as setting tools. In these cases, electrical communication must be able to pass through one perforating gun to other tools in the string. Typically, this involves threading at least one wire through the interior of the perforating gun and using the gun body as a ground wire.

When typical a perforating gun is assembled/loaded either at the well site or at a service company shop, there is risk of incorrect assembly or damage to electrical wiring or other components that may cause the perforating gun or other tools to fail to fire or fail to function appropriately. For example, the threading of a pass-through wire through the gun body or charge holder presents numerous opportunities for the insulation of the wire to be stripped on sharp metal edges resulting in shorts in the communications circuit. Accordingly, there is a need for a system that eliminates the need to run a wire through a perforating gun body.

Typically, perforating guns and other tools are connected to each other electrically at the well site. This requires that a worker bring the guns or tools close together and then manually make a connection with one or more wires. This requires time and manpower at the well site and introduces the possibility of injury or assembly error. Accordingly, there is a need for a system that eliminates the requirement for workers to make wire connections between perforating guns or tools at the well site.

As discussed above, perforating guns and other tools are often connected with subs that also house related electronic and/or ballistic components. In order to eliminate these subs, a system is needed to house these electrical and ballistic components inside of perforating guns or other tools in an interchangeable and modular way. Additionally, current perforating guns typically have the same diameter and female threads on both ends. In order to eliminate the subs, a perforating gun system that provides male threads on one end of the gun and female threads on the other is needed.

SUMMARY OF EXAMPLE EMBODIMENTS

The example embodiments may utilize EB Fire dual diodes and pressure switches in a cartridge in place of a control fire switch. The EB Fire Cartridge may encompass a dual diode or pressure switch as well as the pressure bulkhead needed for sealing and the detonator needed to initiate the detonating cord of the subsequent gun. The guns used in this system may use the charge tube as the conductor to eliminate through wires. The guns may feature an end fitting to capture the detonator end of the EBC in order to successfully achieve end to end transfer between detonator and detonating cord. The guns may have a swaged pin end or be box by box and use non-ported tandem subs between each gun.

An example embodiment may include a method of perforating a well including loading a first perforating gun with perforating charges and detonating cord, loading a second perforating gun with perforating charges and detonating cord, inserting a cartridge holding a detonator into a tandem sub, inserting a detonation transfer end fitting into the perforating gun, inserting a detonating cord into the detonation transfer end fitting, coupling the first perforating gun to a first end of the tandem sub, coupling the second perforating gun to the second end of the tandem sub, assembling the first perforating gun, the tandem sub, and the second perforating gun in a tool string, conveying the tool string into the well, detonating the second perforating gun with an electrical signal, wherein the detonation of the second arms the cartridge within the tandem sub, and detonating the first perforating gun with an electrical signal using the armed cartridge.

A variation of the example embodiment may include the cartridge having at least one electrical contact proximate each end. At least one of the electrical contacts of the cartridge may be resiliently biased. At least one of the electrical contacts of the cartridge may be a compression spring. The cartridge may also hold a switch electrically connected to the detonator. The example may include conveying the first perforating gun to a well site after loading the first perforating gun with perforating charges and detonating cord. The example may include conveying the first perforating gun to a well site after inserting the cartridge containing the detonator into the perforating gun. It may include connecting the first perforating gun to a second perforating gun by threading the body of the first perforating gun directly into the body of the second perforating gun.

An example embodiment may include a perforating gun system having a first gun body having external threads at a first end and internal threads at a second end, a cartridge housing a detonator, a switch within the cartridge electrically connected to the detonator, a shaped charge loading tube having an upper end and a lower end, at least one insulator between the shaped charge loading tube and the gun body, an upper end fitting on the upper end of the shaped charge loading tube, a detonation transfer sub on the lower end of the shaped charge loading tube, a lower end fitting on the lower end of the shaped charge loading tube, an upper insulating cap on upper end fitting, a lower insulating cap on lower end fitting in which the upper and lower end fittings are conductive, the cartridge has an electrical contact proximate to the detonator, and the lower end of the loading tube has an electrical contact adapted to contact the electrical contact proximate to the detonator.

A variation of the example embodiment may include the cartridge being adapted to be inserted and removed from the perforating gun as a unit. The at least one insulator may include an insulating fitting on an apex end of a plurality of shaped charges. The at least one insulator may include an insulating fitting on an open end of a plurality of shaped charges. The at least one insulator may include an insulating sleeve over the shaped charge loading tube. The cartridge may have at least one electrical contact at each end. At least one of the electrical contacts of the cartridge may be a compression spring. The cartridge may have at least one electrical contact at each end.

An example embodiment may include a perforating gun tandem sub having a first metallic cylindrical body with a first end, a second end, a center axis, an inner bore coaxial with the center axis, a cylindrical cartridge located within the inner bore with a first end holding a detonator having a first lead wire and a second lead wire, and a second end holding a detonation activated switch, wherein the first end of the metallic cylindrical body is adapted to couple to a first perforating gun and the second end of the metallic cylindrical body is adapted to couple to a second perforating gun.

The example may include a bulkhead coupled to the second end of the cylindrical cartridge adapted to seal against an end fitting of a charge tube located in a second perforating gun. It may have a diode wired between the pressure activated switch and the first lead wire of the detonator, in which the diode designates the polarity of the pressure activated switch. It may have a grounding wire coupled to the second lead wire of the detonator and to the metallic cylindrical body. It may have a feed thru wire traveling from the first end of the cylindrical cartridge and electrically coupled to the pressure activated switch.

BRIEF DESCRIPTION OF THE DRAWINGS

For a thorough understanding of the present invention, reference is made to the following detailed description of the preferred embodiments, taken in conjunction with the accompanying drawings in which reference numbers designate like or similar elements throughout the several figures of the drawing. Briefly.

DETAILED DESCRIPTION OF EXAMPLES OF THE INVENTION

In the following description, certain terms have been used for brevity, clarity, and examples. No unnecessary limitations are to be implied therefrom and such terms are used for descriptive purposes only and are intended to be broadly construed. The different apparatus, systems and method steps described herein may be used alone or in combination with other apparatus, systems and method steps. It is to be expected that various equivalents, alternatives, and modifications are possible within the scope of the appended claims. Directional and orientation terms such as upper, lower, top, and bottom are used in this description for convenience and clarity in describing the features of components. However, those terms are not inherently associated with terrestrial concepts of up and down or top and bottom as the described components might be used in a well.

Figure 1:
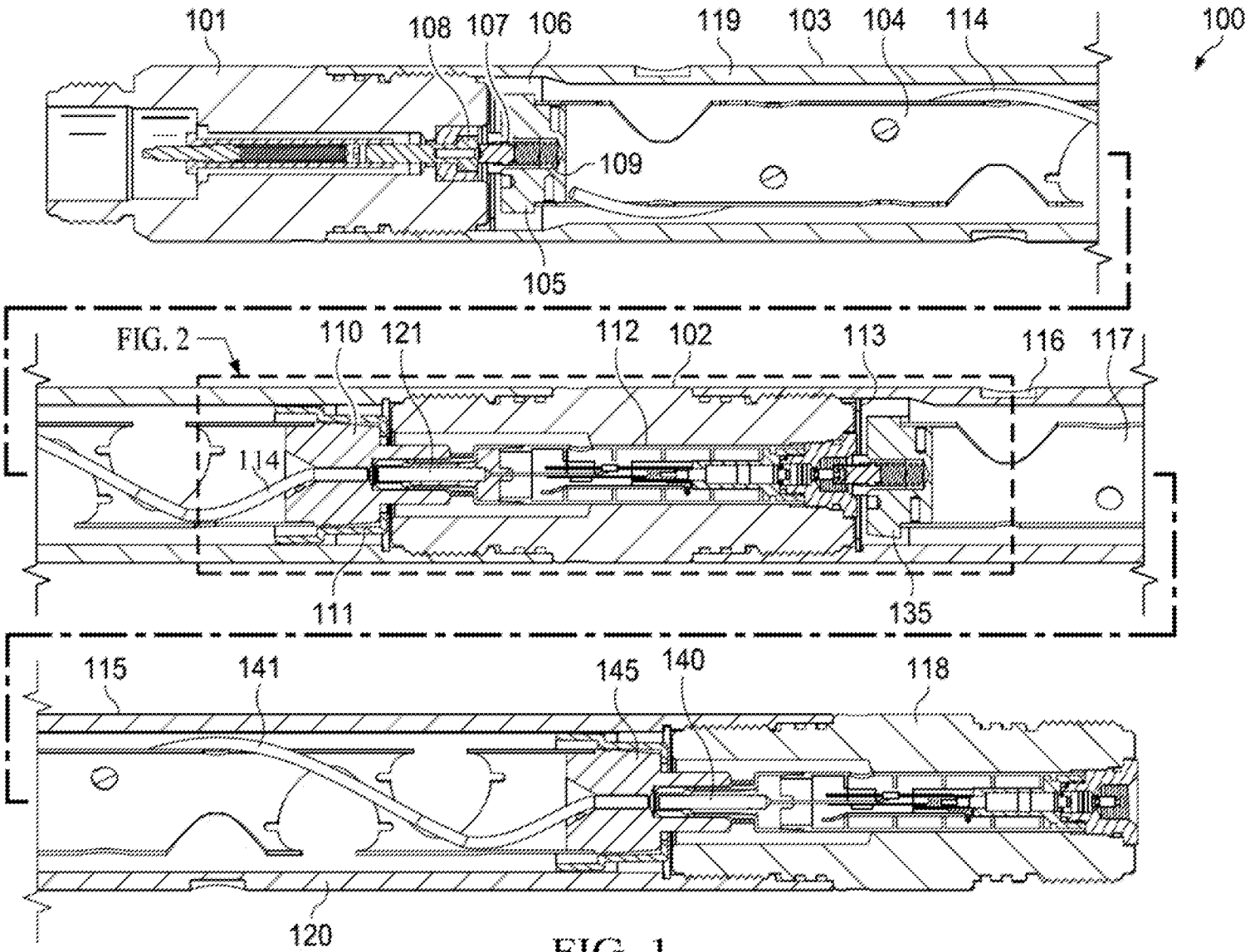
FIG. 1 is a side cross section view of a portion of a perforating gun tool string.

FIG. 1 depicts an example embodiment of a portion of a gun string 100. The top assembly 101 is uphole of and coupled to the first perforating gun 103. The first perforating gun 103 is uphole of and coupled to the first tandem sub 102. The tandem sub 102 is uphole of and coupled to the second perforating gun 115. The second perforating gun 115 is uphole of and coupled to the second tandem sub 118. The charge tube 104 of the first perforating gun 103 is held in place by a top end fitting 105 and a detonation transfer end fitting 110. The insulation cap 106 electrically insulates the end fitting 105 from the gun body 119 of the first perforating gun 103. The insulation cap 111 electrically insulates the end fitting 110 from the gun body 119 of the first perforating gun 103. A detonation cord 114 is routed from the top end fitting 105 to the detonation transfer end fitting 110 around the charge tube 104 in such a way as to couple to the ends of each shaped charge (not shown) that is inserted into the charge tube 104. The second perforating gun 115 also has a detonating cord 141 routed around the charge tube 117 and routed from end to end of the charge tube 117. The second perforating gun 115 is has the charge tube 115 electrically isolated from the gun body 120 via end fittings 135 and 145.

Figure 2:
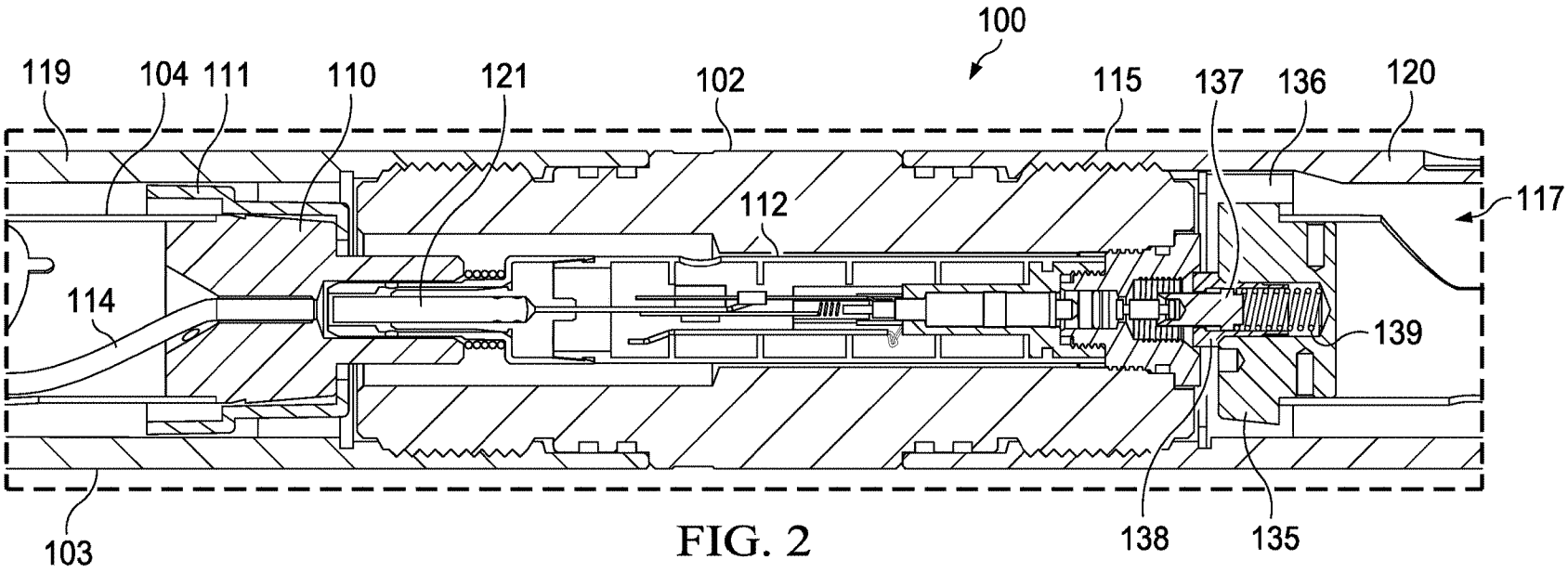
FIG. 2 is a side cross section view of a tandem sub coupled to a perforating gun on either end.

For electrical communication, the gun body of each perforating gun acts as a ground, while the hot wire is the charge tube, which is electrically isolated from the gun body using insulation caps at either end of the charge tube. The electrical connection from the top sub 101 to the charge tube 104 of the first perforating gun 103 is by way of a feed thru contact pin 107 slideably engaged with a contact retainer 108 preloaded with a compression spring 109. The tandem sub 102 provides an electrical pathway from the charge tube 104 as shown in FIG. 2 through the detonation transfer end fitting 110, through the cartridge assembly 112 that is electrically isolated from the body of the tandem sub 102, and through feed thru contact pin 137, which is slideably engaged with contact retainer 138, the hot path makes contact with the end fitting 135, which is electrically coupled to the charge tube 117, and contact is maintained via spring 139.

An example of the perforating gun firing sequence may include arming the tandem sub 118 via perforating gun located downhole of the tandem sub 118. The shock of the explosion of a perforating gun will arm the detonator 140. An electrical signal sent via the hot connection will then activate detonator 140, thus setting off detonating cord 141 along with any shaped charges located within charge tube 117. The shock and gas expansion associated with the detonation of perforating gun 115 will move the feed thru contact pin 137, thus arming detonator 121 by putting it in electrical contact with the hot and ground sides of the tandem sub 102. An electrical signal is then sent from the surface to detonate the detonating cord 114 via detonator 121. The detonation of the detonating cord 114 will cause all of the shaped charges installed in the charge tube 104 to detonate as well.

Figure 3:
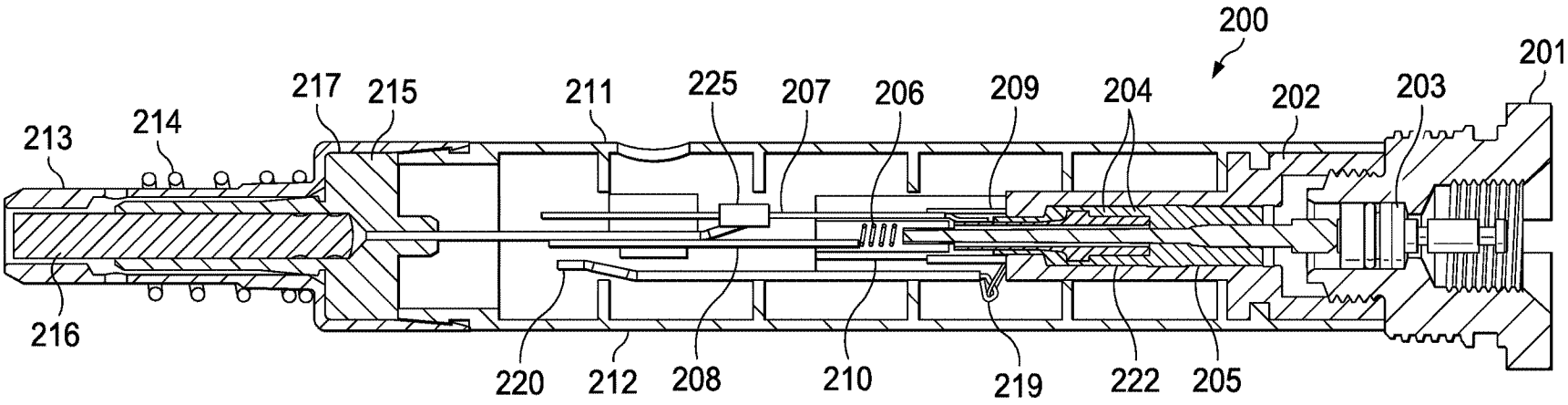
FIG. 3 is a side cross section view of a cartridge style switch and detonator assembly.

An example cartridge assembly 200 is shown in FIG. 3, which is a side view of the assembly. A top case 211 is coupled to a bottom case 212. An EB switch housing 202 is located within the cartridge assembly 200 and a bulkhead is coupled, in this example threaded, into the EB switch housing 202. A piston assembly 203 is located within the bulkhead 201 and may be composed of PEEK or some other non-conductive material. A firing pin assembly 205 is spring loaded and located within the brass receptacle assembly 204. A dart wire connection spring 206 is coupled to the firing pin assembly 205. Insulation 209 and 210 provide electrical insulation between the firing pin assembly 205 and the top and bottom cases 211 and 212, respectively. Switch wire 208 is connected between the detonator 216 and the dart wire connection spring 206. Diode assembly 207 provides the one-way electrical contact between the EB switch housing with the ground when the switch is armed, however the circuit is installed in this example as open. Metal end cap 213, in conjunction with contact spring 214, is adapted to couple to a detonation transfer end fitting. Detonation sleeve 215 electrically isolates the detonator 216 from the hot side of the circuit.

Figure 4:
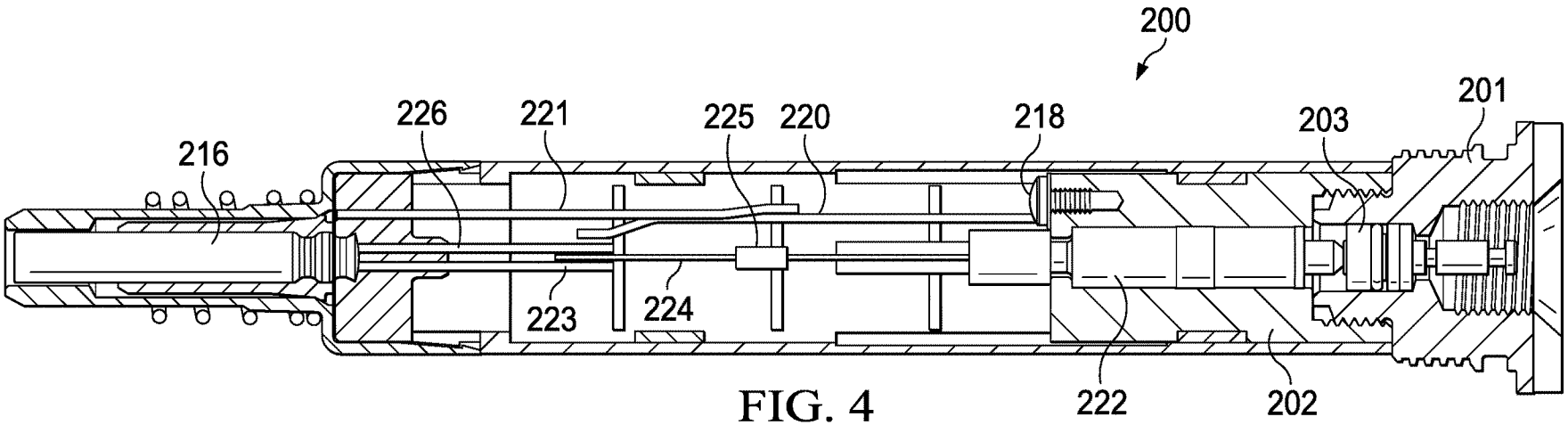
FIG. 4 is a top cross section view of a cartridge style switch and detonator assembly.

Another view of the example embodiment depicts a top cross-sectional view of cartridge assembly 200 in FIG. 4. The bulkhead 201 contains the piston assembly 203 and is coupled to the EB switch housing 202, which contains the EB switch 222. Feed thru wire and washer 217 connects to feed thru wire 221. The detonator 216 has a first lead wire 226 and a second lead wire 223. Wire 224 coming off of diode assembly 207 is connected to the first lead wire 226. Ground screw 218 and ground lug 219 provide the grounding for ground wire 220 which is attached to the second lead wire 223 from the detonator 216. Diode 225 designates the polarity of the switch, either positive or negative. The feed thru wire 221 is connected to the switch wire 208.

Although the invention has been described in terms of embodiments which are set forth in detail, it should be understood that this is by illustration only and that the invention is not necessarily limited thereto. For example, terms such as upper and lower or top and bottom can be substituted with uphole and downhole, respectfully. Top and bottom could be left and right, respectively. Uphole and downhole could be shown in figures as left and right, respectively, or top and bottom, respectively. Generally downhole tools initially enter the borehole in a vertical orientation, but since some boreholes end up horizontal, the orientation of the tool may change. In that case downhole, lower, or bottom is generally a component in the tool string that enters the borehole before a component referred to as uphole, upper, or top, relatively speaking. The first housing and second housing may be top housing and bottom housing, respectfully. Terms like wellbore, borehole, well, bore, oil well, and other alternatives may be used synonymously. The alternative embodiments and operating techniques will become apparent to those of ordinary skill in the art in view of the present disclosure. Accordingly, modifications of the invention are contemplated which may be made without departing from the spirit of the claimed invention.

What is claimed is:

1. A method of perforating a well comprising:

loading a first perforating gun with perforating charges and a first detonating cord;

loading a second perforating gun with perforating charges and the first detonating cord;

inserting a cartridge containing a detonator into a tandem sub, wherein the detonator is at least partially disposed within the tandem sub;

inserting a detonation transfer end fitting into first perforating gun;

inserting the first detonating cord into the detonation transfer end fitting;

coupling the first perforating gun to a first end of the tandem sub;

coupling the second perforating gun to the second end of the tandem sub;

assembling the first perforating gun, the tandem sub, and the second perforating gun in a tool string;

conveying the tool string into the well;

detonating the second perforating gun with an electrical signal, wherein the detonation of the second perforating gun arms the cartridge within the tandem sub; and detonating the first perforating gun with an electrical signal using the armed cartridge.

2. The method of claim 1 wherein the cartridge has at least one electrical contact proximate each end.

3. The method of claim 2 wherein at least one of the electrical contacts of the cartridge is resiliently biased closed.

4. The method of claim 3 wherein at least one of the electrical contacts of the cartridge is a compression spring.

5. The method of claim 2 wherein the cartridge also holds a switch electrically connected to the detonator.

6. The method of claim 1 further comprising:

conveying the first perforating gun to a well site after loading the first perforating gun with perforating charges and detonating cord.

7. The method of claim 1 further comprising:

conveying the first perforating gun to a well site after inserting the cartridge containing the detonator into the perforating gun.

8. The method of claim 1 further comprising:

connecting the first perforating gun to a second perforating gun by threading the body of the first perforating gun directly into the body of the second perforating gun.

* * * * *